US012435531B2

(12) United States Patent
Zhang

(10) Patent No.: US 12,435,531 B2
(45) Date of Patent: Oct. 7, 2025

(54) POOL ROBOT

(71) Applicant: XINGMAI INNOVATION TECHNOLOGY (SUZHOU) CO., LTD., Jiangsu (CN)

(72) Inventor: Shilei Zhang, Suzhou (CN)

(73) Assignee: XINGMAI INNOVATION TECHNOLOGY (SUZHOU) CO., LTD., Suzhou (CN)

( * ) Notice: Subject to any disclaimer, the term of this patent is extended or adjusted under 35 U.S.C. 154(b) by 0 days.

(21) Appl. No.: 19/031,492

(22) Filed: Jan. 18, 2025

(65) Prior Publication Data

US 2025/0146316 A1 May 8, 2025

Related U.S. Application Data

(63) Continuation-in-part of application No. PCT/CN2023/116840, filed on Sep. 4, 2023.

(30) Foreign Application Priority Data

Mar. 20, 2023 (CN) ..... 202310269067.4

(51) Int. Cl.
*E04H 4/16* (2006.01)
*A47L 11/40* (2006.01)

(52) U.S. Cl.
CPC ..... *E04H 4/1654* (2013.01); *A47L 11/4027* (2013.01); *A47L 11/4075* (2013.01); *A47L 2201/00* (2013.01)

(58) Field of Classification Search
CPC ..... E04H 4/1654; A47L 11/4027; A47L 11/4075; A47L 2201/00; B08B 9/08; B25J 11/0085

(Continued)

(56) References Cited

U.S. PATENT DOCUMENTS 4,064,586 A * 12/1977 Caron ..... E04H 4/1654 210/167.16
5,105,496 A 4/1992 Gray, Jr.
(Continued)

FOREIGN PATENT DOCUMENTS

CN 205805047 U * 12/2016
CN 207700775 U 8/2018
(Continued)

OTHER PUBLICATIONS

Machine translation of CN-218467262-U (Year: 2023).*
(Continued)

*Primary Examiner* — Michael E Barr
*Assistant Examiner* — Thomas Bucci
(74) *Attorney, Agent, or Firm* — Soleado Law, PC

(57) ABSTRACT

This application relates to a pool robot. The pool robot includes a housing, a filtering box, and a water baffle plate. The housing is provided with a first water outlet hole and an accommodation cavity. The filtering box is disposed in the accommodation cavity. A side wall of the accommodation cavity is provided with a second water outlet hole. The water baffle plate is connected to a side of the side wall of the accommodation cavity, and the side is away from the filtering box. The water baffle plate is provided over the second water outlet hole. When the pool robot is located in water, the water baffle plate closes the second water outlet hole. When the pool robot leaves the water, the water baffle plate is opened, and water in the filtering box is drained through the second water outlet hole and the first water outlet hole.

20 Claims, 5 Drawing Sheets

(58) Field of Classification Search
USPC ..... 134/201
See application file for complete search history.

(56) References Cited

U.S. PATENT DOCUMENTS

| | | | | | |
|---|---|---|---|---|---|
| 5,172,445 | A * | 12/1992 | Chandler | E04H 4/1654 | 15/387 |
| 6,886,205 | B1 | 5/2005 | Pichon | | |
| 9,708,826 | B2 | 7/2017 | Michelon | | |
| 10,294,686 | B1 * | 5/2019 | Erlich | B63H 11/107 | |
| 10,844,621 | B2 | 11/2020 | Klebanov | | |
| 2007/0028405 | A1 | 2/2007 | Garti | | |
| 2009/0277821 | A1 * | 11/2009 | Hui | E04H 4/1654 | 210/167.16 |
| 2011/0088182 | A1 | 4/2011 | Hui | | |
| 2013/0152316 | A1 * | 6/2013 | Rief | E04H 4/16 | 15/1.7 |
| 2014/0076789 | A1 * | 3/2014 | Shlomi-Shlomi | E04H 4/1209 | 901/44 |
| 2016/0145884 | A1 * | 5/2016 | Erlich | E04H 4/1654 | 15/1.7 |
| 2016/0298351 | A1 * | 10/2016 | Blanc Tailleur | E04H 4/1209 | |
| 2018/0163422 | A1 | 6/2018 | Klebanov | | |
| 2020/0095792 | A1 * | 3/2020 | Miller | E04H 4/1654 | |
| 2020/0270890 | A1 * | 8/2020 | Schloss | E04H 4/1654 | |
| 2024/0294242 | A1 * | 9/2024 | Wei | B63B 79/15 | |

FOREIGN PATENT DOCUMENTS

| | | | | | |
|---|---|---|---|---|---|
| CN | 208380175 | U | | 1/2019 | |
| CN | 210178034 | U | | 3/2020 | |
| CN | 213049697 | U | | 4/2021 | |
| CN | 214776472 | U | | 11/2021 | |
| CN | 114278129 | A | | 4/2022 | |
| CN | 216543395 | U | | 5/2022 | |
| CN | 216553236 | U | * | 5/2022 | |
| CN | 115324395 | A | | 11/2022 | |
| CN | 115492431 | A | * | 12/2022 | E04H 4/1654 |
| CN | 218306593 | U | | 1/2023 | |
| CN | 218467262 | U | * | 2/2023 | |
| CN | 116060396 | A | | 5/2023 | |
| CN | 116201405 | A | * | 6/2023 | E04H 4/16 |
| CN | 116517357 | A | | 8/2023 | |
| WO | 2023273833 | A1 | | 1/2023 | |

OTHER PUBLICATIONS

Notification of grant of patent right for invention for Chinese Application 202310269067.4 mailed on Oct. 31, 2024, 3 pages.
Foreign Search Report (English translated) for CN Application No. 2023102690674.
Foreign Office Action (English translated) for CN Application No. 202310269067.4.
International Search Report for WO2024192980.
Written Opinion of the International Searching Authority for WO2024192980.

* cited by examiner

POOL ROBOT

This application is a continuation-in-part application of International Patent Application No. PCT/CN2023/116840, filed on Sep. 4, 2023, which claims priority to Chinese Patent Application No. 2023102690674, filed with the China National Intellectual Property Administration on Mar. 20, 2023 and entitled "POOL ROBOT", which is incorporated herein by reference in its entirety.

TECHNICAL FIELD

This application relates to the technical field of pool working devices, and in particular, to a pool robot.

BACKGROUND

As an automatic device working in a pool, a pool robot can automatically complete work such as pool cleaning, thereby reducing time for a user. Therefore, the pool robot is widely praised by the user.

However, because the pool robot works in water, there are two common problems of the pool robot in the conventional technology, which greatly affect user experience but have not been resolved for a long time. First, when the pool robot is in water, there is a large amount of water inside the pool robot, so it is necessary to make significant effort to extract the pool robot from the water. Second, after the pool robot is extracted from a water surface, the water inside the pool robot needs to be drained, but a drainage speed is slow.

SUMMARY

An objective of this application is to propose a pool robot, which can improve a drainage speed of the pool robot in a process of leaving water, quickly reduce a weight of the pool robot, and therefore help improve user experience.

To achieve the objective, this application uses the following technical solutions.

A pool robot includes:

a housing, wherein a lower end surface of the housing is provided with a first water outlet hole, and the housing is provided with an accommodation cavity;

a filtering box disposed in the accommodation cavity, wherein a side wall of the accommodation cavity is provided with a second water outlet hole; and a water baffle plate, wherein a part of the water baffle plate is connected to a side of the side wall of the accommodation cavity, wherein the side of the side wall is away from the filtering box, the water baffle plate is provided over the second water outlet hole, when the pool robot is located in water, the water baffle plate closes the second water outlet hole, and in a process in which the pool robot is leaving the water, the water baffle plate is opened, and water in the filtering box flows out through the second water outlet hole and is drained from the housing through the first water outlet hole, wherein in the process in which the pool robot is leaving the water, the first water outlet hole is located lower than the second water outlet hole.

In an optional solution, the housing is provided with a first water inlet, and water enters the housing through the first water inlet.

In an optional solution, the filtering box further includes a cover plate, the cover plate is provided on a liquid inlet, and the cover plate is configured to adjust an open state and a closed state of the liquid inlet.

In an optional solution, the first water inlet faces and communicates with the liquid inlet.

In an optional solution, a filtering mesh is provided on the filtering box, and the filtering mesh is configured to perform filtering.

In an optional solution, the pool robot includes a filtering box cavity, the accommodation cavity is formed in the filtering box cavity, and the filtering box is disposed in the containing cavity.

In an optional solution, the pool robot further includes a handle provided on the housing, which is convenient for a user to hold. In addition, when the handle is lifted, the side wall provided with the second water outlet hole tilts. The handle may be provided at a front end or a rear end of the housing.

In an optional solution, the first water outlet hole is close to a lowest point of the housing when the handle is lifted.

In an optional solution, the lower end surface of the housing is connected to a rear end surface of the housing through a gap, and a first water outlet hole is formed by the gap. In an optional solution, the first water outlet hole formed by the gap and the first water outlet hole provided on the lower end surface of the housing may exist at the same time.

In an optional solution, the second water outlet hole may be provided on a side wall of the accommodation cavity, and the side wall is away from the handle.

In an optional solution, in a state in which the pool robot is lifted, the second water outlet hole is configured to be provided on a side wall at which a lowest point of the accommodation cavity is located.

In an optional solution, the second water outlet hole may alternatively be provided on a bottom wall of the accommodation cavity.

In an optional solution, the second water outlet hole is provided close to the lower end face of the housing.

In an optional solution, the side wall of the accommodation cavity is provided with a water inlet hole, and the water inlet hole is provided close to an upper end face of the housing.

In an optional solution, the housing is further provided with a first cavity. The first cavity includes a first sub-cavity and a second sub-cavity. The first sub-cavity and the second sub-cavity are separated from each other. The water inlet hole is provided on the side wall of the accommodation cavity. The accommodating cavity communicates with the first sub-cavity through the water inlet hole. A third water outlet hole is provided on the housing and communicates with the first sub-cavity. The second water outlet hole communicates with the second sub-cavity body. The second water outlet hole is located between the first water inlet and the first water outlet hole along a moving direction of the pool robot.

In an optional solution, the housing is further provided with a second cavity. The second cavity is provided in the second sub-cavity. The second cavity communicates with the accommodation cavity through the second water outlet hole. A side wall of the second cavity is provided with a fourth water outlet hole. The fourth water outlet hole communicates with the second sub-cavity.

In an optional solution, the second cavity is independent of the second sub-cavity. The fourth water outlet hole serves as the first water outlet hole of the housing. The water baffle plate is disposed on the lower end face of the housing. A part of the water baffle plate is connected to the lower end face of the housing, that is, the water baffle plate is partially connected to the lower end face of the housing. The water baffle plate is provided over the fourth water outlet hole (namely, the first water outlet hole).

In an optional solution, the water baffle plate is made of a flexible waterproof material.

In an optional solution, the water baffle plate is movably provided on an outer side wall of the accommodation cavity through an elastic member.

In an optional solution, when the pool robot is in water, the water baffle plate is attached to an outer side of the side wall under the action of water pressure inside and outside the second water outlet hole, so that the second water outlet hole is closed, and in the process in which the pool robot is leaving the water, the water baffle plate is located lower than the filtering box, and the water baffle plate is opened under the action of gravity of water.

In an optional solution, the water baffle plate includes:

a body provided over the second water outlet hole; and a rotating shaft disposed between the side wall and the body, wherein the rotating shaft is located at an upper side of the second water outlet hole, and the body is rotatably connected to the rotating shaft.

In an optional solution, the water baffle plate is driven by a driving assembly to move, and the driving assembly includes:

a motor in transmission connection to the rotating shaft;

a control system electrically connected to the motor; and a sensor electrically connected to the control system and configured to detect a water-leaving state of the pool robot.

In an optional solution, the sensor is an attitude sensor or a water pressure sensor.

In an optional solution, the second water outlet hole is provided on the side wall or the bottom of the accommodation cavity.

In an optional solution, a surface area of the water baffle plate facing the second water outlet hole is greater than an area of the second water outlet hole, and a part of a perimetrical boundary of the water baffle plate is connected to the side wall.

In an optional solution, the pool robot further includes:

a filtering member disposed on an inner wall of the filtering box, wherein the inner wall corresponds to the second water outlet hole, or disposed at the first water outlet hole.

In an optional solution, an area of the first water outlet hole ranges from 2000 $mm^2$ to 6000 $mm^2$.

In an optional solution, when the handle is lifted, the lower end surface of the housing and a horizontal plane form an included angle of 45° to 75°.

In an optional solution, in a state in which the handle is lifted, the first water outlet hole is located lower than the second water outlet hole.

In an optional solution, the filtering box is provided with a liquid inlet and a liquid outlet, and the pool robot further includes:

a filter driving assembly, wherein the filter driving assembly is configured to drive the pool robot to suck water in a pool, the water enters the filtering box through the liquid inlet, garbage remains in the filtering box after the water is filtered by the filtering box, and cleaned water is drained from the liquid outlet.

In an optional solution, the filter driving mechanism includes a main water pump. The main water pump includes an impeller and a motor that drives the impeller to rotate.

In an optional solution, the pool robot further includes an electric control box having a sealed mounting cavity.

In an optional solution, the motor of the main water pump is disposed in the electric control box, and an output shaft or a transmission shaft of the motor extends out of a sealed upper cover of the electric control box and extends into the first sub-cavity to be connected to the impeller to drive the impeller to rotate.

In an optional solution, there are a plurality of first water outlet holes, and the plurality of first water outlet holes are provided in an array.

In an optional solution, there are a plurality of second water outlet holes, and the plurality of second water outlet holes are provided in an array.

A pool robot includes:

a housing, wherein a lower end surface of the housing is provided with a first water outlet hole, and the housing is provided with an accommodation cavity;

a filtering box disposed in the accommodation cavity, wherein a side wall of the accommodation cavity is provided with a second water outlet hole; and a water baffle plate, wherein a part of the water baffle plate is connected to a side of the side wall of the accommodation cavity, wherein the side of the side wall is away from the filtering box, the water baffle plate is provided over the second water outlet hole, when water pressure inside the second water outlet hole is less than water pressure outside the housing, the water baffle plate is attached to the side of the side wall, wherein the side of the side wall is away from the filtering box, and when water pressure inside the second water outlet hole is greater than water pressure outside the housing, the water baffle plate is opened, and a part of the water baffle plate, wherein the part is not connected to the side wall, is driven, under the action of gravity of water, to be separated from the side wall to form a gap, so that water is capable of being quickly drained from the gap.

A pool robot includes:

a housing, wherein a lower end surface of the housing is provided with a first water outlet hole, and the housing is provided with an accommodation cavity;

a filtering box disposed in the accommodation cavity, wherein a side wall of the accommodation cavity is provided with a second water outlet hole; and a water baffle plate, wherein a part of the water baffle plate is connected to a side of the side wall of the accommodation cavity, wherein the side of the side wall is away from the filtering box, the water baffle plate is provided over the second water outlet hole to close or open the second water outlet hole, and when the pool robot moves to a position at which the side wall tilts, the water baffle plate is opened, and water in the filtering box flows out through the second water outlet hole and is drained from the housing through the first water outlet hole.

BRIEF DESCRIPTION OF DRAWINGS

To describe technical solutions in embodiments of this application more clearly, the following briefly introduces the accompanying drawings required for describing embodiments of this application. It is clear that the accompanying drawings in the following description show merely some embodiments of this application, and a person of ordinary skill in the art may still derive other drawings from the content of embodiments of this application and these accompanying drawings without creative efforts.

REFERENCE NUMERALS

Figure 1:
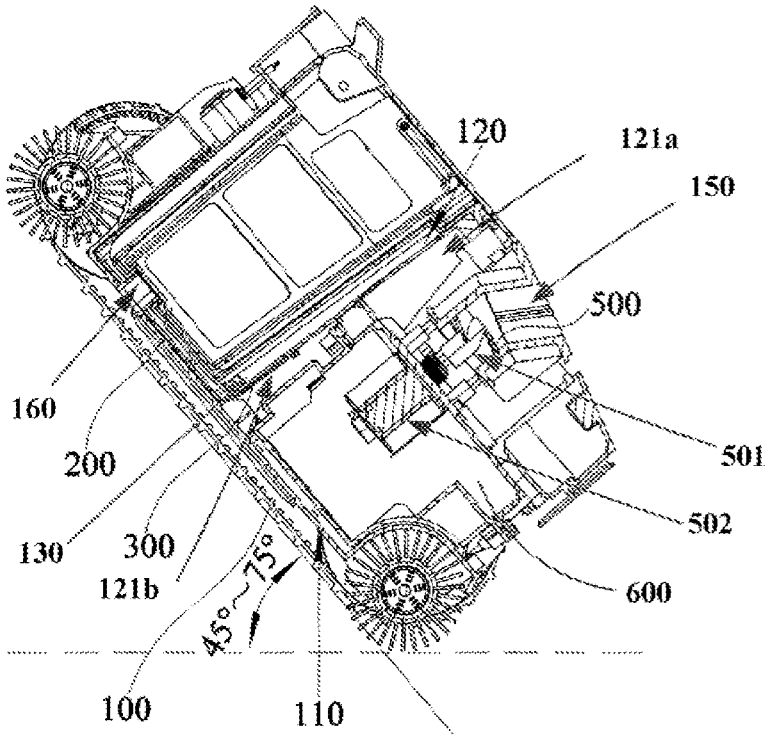
FIG. 1 is a diagram 1 of a cross-sectional structure of a pool robot according to an embodiment of this application.

100: housing; 101: rear end surface; 110: first water outlet hole; 120: accommodation cavity; 121: first cavity; 121*a*: first sub-cavity; 121*b*: second sub-cavity; 122: second cavity; 123: first side wall; 124: second side wall; 125: third side wall; 126: fourth side wall; 127: bottom wall; 700: filtering box cavity; 130: second water outlet hole; 140: water inlet hole; 150: third water outlet hole; 160: first water inlet; 170: fourth water outlet hole; 200: filtering box; 201: filtering mesh; 202: liquid inlet; 203: cover plate; 300: water baffle plate; 400: handle; 500: filter driving assembly; 501: impeller; 502: motor; 600: electric control box.

DESCRIPTION OF EMBODIMENTS

The following further describes this application with reference to the accompanying drawings and embodiments. It may be understood that the specific embodiments described herein are merely used to explain this application, but are not intended to limit this application. In addition, it should be noted that, for ease of description, only a part but not all of a structure related to this application is shown in the accompanying drawings.

In descriptions of this application, unless otherwise expressly specified and limited, the terms such as "link", "connect", and "fasten" should be understood broadly. For example, the term "connect" may indicate a fixed connection, a detachable connection, or an integral connection, may indicate a mechanical connection or an electrical connection, or may indicate a direct connection, an indirect connection implemented through an intermediate medium, or communication between internal structures of two elements or an interaction relationship between two elements. A person of ordinary skill in the art may understand specific meanings of the foregoing terms in this application based on a specific situation.

In this application, unless otherwise expressly specified and limited, that a first feature is "above" or "below" a second feature may be that the first feature may be in direct contact with the second feature, or the first feature may be in contact with the second feature through another feature between the first feature and the second feature instead of being in direct contact with the second feature. In addition, that the first feature is "above", "on", or "over" the second feature may be that the first feature is right above or obliquely above the second feature, or merely mean that a horizontal height of the first feature is greater than that of the second feature. That the first feature is "below", "underneath", or "under" the second feature may be that the first feature is right below or obliquely below the second feature, or merely mean that a horizontal height of the first feature is less than that of the second feature.

In descriptions of embodiments, an orientation or position relationship indicated by terms "above", "below", "left", "right", and the like is an orientation or position relationship based on the accompanying drawings, and is only intended to facilitate descriptions and simplify operations, but is not intended to indicate or imply that an apparatus or an element needs to have a specific orientation and be constructed and operated in a specific orientation. Therefore, such terms cannot be understood as a limitation on this application. In addition, the terms "first" and "second" are merely used to distinguish in description and have no special meaning.

As shown in FIG. 1 to FIG. 4, an embodiment provides a pool robot, and the pool robot works in a pool. Currently, a commonly used pool robot is mainly configured to clean a bottom surface and a wall surface of a pool. The pool robot includes a housing 100 and a filtering box 200. The housing 100 is provided with an accommodation cavity 120. The filtering box 200 is disposed in the accommodation cavity 120. The pool robot further includes a filter driving assembly 500. The filtering box 200 is provided with a liquid inlet 202 and a liquid outlet. The filter driving assembly 500 can drive the pool robot to suck water in the pool. The water enters the filtering box 200 through the liquid inlet 202, garbage remains in the filtering box 200 after the water is filtered by the filtering box 200, and cleaned liquid is drained from the liquid outlet.

Figure 2:
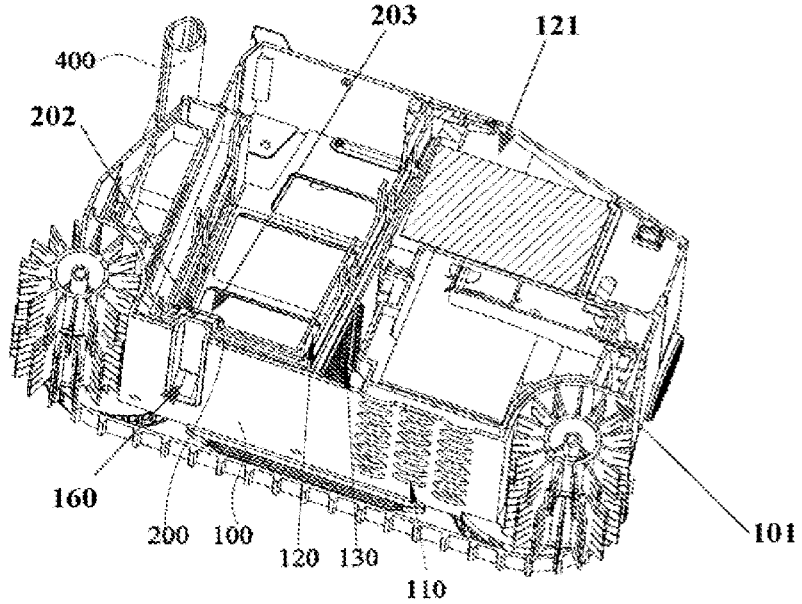
FIG. 2 is a diagram 2 of a cross-sectional structure of a pool robot according to an embodiment of this application.

In an embodiment, the filtering box 200 further includes a cover plate 203. The cover plate 203 is provided on the liquid inlet 202, and the cover plate 203 is configured to adjust an open state and a closed state of the liquid inlet 202. When the liquid inlet 202 is in the open state, water can enter the filtering box 200 through the liquid inlet 202. When the liquid inlet 202 is in the closed state, water cannot enter the filtering box 200 through the liquid inlet 202. As shown in FIG. 2, the cover plate 203 may be disposed in the liquid inlet 202. The cover plate 203 may be disposed inside the liquid inlet 202 or outside the liquid inlet 202.

In an embodiment, as shown in FIG. 2, the housing 100 is provided with a first water inlet 160, and water enters the housing 100 through the first water inlet 160. In an embodiment, the first water inlet 160 faces and communicates with the liquid inlet 202, that is, liquid enters the filtering box 200 through the first water inlet 160 and the liquid inlet 202 sequentially.

Figure 5:
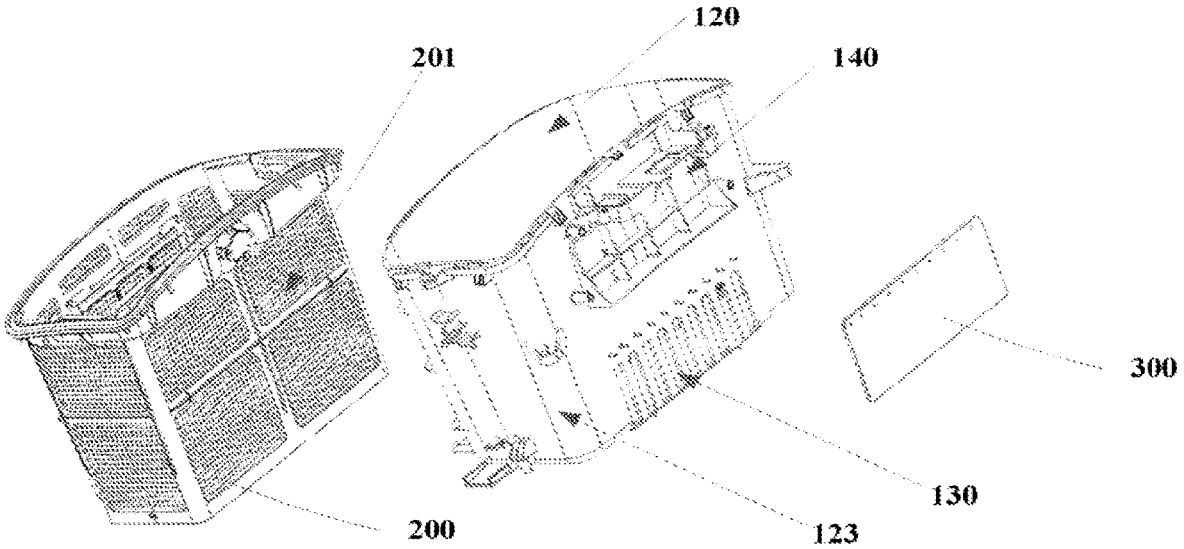
FIG. 5 is a partial exploded diagram of a pool robot according to an embodiment of this application.

In an embodiment, as shown in FIG. 5, a filtering mesh 201 is provided on the filtering box 200. The filtering mesh 201 is configured to perform filtering. A filtering mesh hole of the filtering mesh 201 serves as a liquid outlet of the filtering box 200. The filter driving assembly 500 can drive the pool robot to suck water in the pool. The water enters the filtering box 200 through the liquid inlet 202, garbage remains in the filtering box 200 after the water is filtered by the filtering mesh 201 of the filtering box 200, and the water is drained from the filtering mesh hole of the filtering mesh 201.

In an embodiment, as shown in FIG. 5, the pool robot includes a filtering box cavity 700. The accommodation cavity 120 is formed in the filtering box cavity 700. The filtering box 200 is disposed in the accommodation cavity 120.

When the pool robot works in water, water enters the housing 100 through various gaps on the housing 100.

Therefore, a large amount of water remains inside a body of the pool robot. When a user lifts the pool robot out of a water surface, a weight of the pool robot is large due to a weight of the water in the housing 100, and the user needs to make significant effort to lift the body out of the water surface. After the body is lifted out of the water surface, due to a slow drainage speed of the housing 100, it takes a long time to completely drain the water in the housing 100, which is time-consuming and poor in user experience.

As shown in FIG. 1 and FIG. 2, in this embodiment, a lower end surface of the housing 100 is provided with a first water outlet hole 110, so that the water inside the housing 100 can be quickly drained from the first water outlet hole 110 in or after a process in which the pool robot is leaving the water (that is, leaving the water surface). A side wall of the accommodation cavity 120 is provided with a second water outlet hole 130. In the process in which the pool robot is leaving the water, the first water outlet hole 110 is located lower than the second water outlet hole 130. The pool robot further includes a water baffle plate 300. A part of the water baffle plate 300 is connected to a side of the side wall of the accommodation cavity 120, and the side of the side wall is away from the filtering box 200, that is, the water baffle plate 300 is partially connected to the side of the side wall of the accommodation cavity 120, and the side of the side wall is away from the filtering box 200. The water baffle plate 300 is provided over the second water outlet hole 130. When the pool robot is located in water, the water baffle plate 300 closes the second water outlet hole 130 to avoid the following case: Water enters the filtering box 200 through the second water outlet hole 130, affecting working efficiency of the pool robot. In or after the process in which the pool robot is leaving the water (that is, leaving the water surface), the water baffle plate 300 is opened, and water in the filtering box 200 can flow out through the second water outlet hole 130 and be drained from the housing 100 through the first water outlet hole 110, so that the water in the filtering box 200 is quickly drained. This improves a drainage speed of the pool robot in the process of leaving the water, quickly reduces the weight of the pool robot, and therefore helps improve user experience. In a process in which the pool robot enters the water, the water can enter the inside of the housing 100 through the first water outlet hole 110. This helps quickly increase the weight of the pool robot, so that the pool robot quickly enters the water, and therefore improves water entry efficiency of the pool robot.

Figure 3:
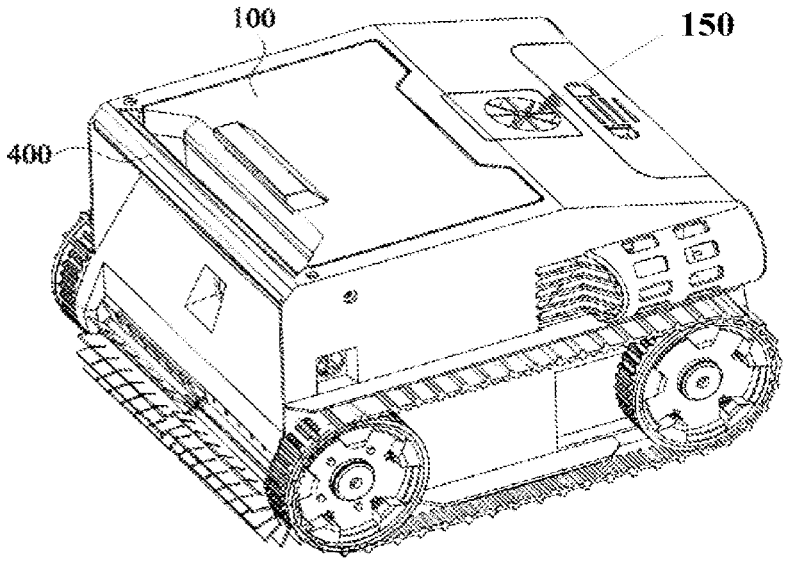
FIG. 3 is a diagram 1 of a structure of a pool robot according to an embodiment of this application.

In an embodiment, the pool robot further includes a handle 400 disposed on the housing 100, which is convenient for a user to hold. In addition, when the handle 400 is lifted, the side wall provided with the second water outlet hole 130 tilts. The handle 400 may be disposed at a front end or a rear end of the housing 100. As shown in FIG. 2 and FIG. 3, the handle 400 is disposed at the front end of the housing 100. It should be noted that the front end is an end located in the front when the pool robot moves forward. When the user takes the pool robot out of the water by using the handle 400, water in the filtering box 200 is quickly drained from the second water outlet hole 130 under the action of gravity. This can ensure drainage efficiency. In addition, the user can easily take out the pool robot.

In an embodiment, in a state in which the handle 400 is lifted, the first water outlet hole 110 is close to a lowest point of the housing 100. Because water flows downward under the action of gravity when the user holds the handle 400 and lifts the pool robot, the first water outlet hole 110 is provided close to the lowest point of the housing 100 when the user holds the handle 400. This helps reduce residual water inside the housing 100 and improve a drainage proportion. As shown in FIG. 2, when the handle 400 is provided at the front end of the housing 100, the first water outlet hole 110 may be provided at a rear end of the lower end surface of the housing 100. When the handle 400 is provided at the rear end of the housing 100, the first water outlet hole 110 is correspondingly provided at a front end of the lower end surface of the housing 100. It should be noted that when the first water outlet hole 110 is provided at the front end of the lower end surface of the housing 100, the first water outlet hole 110 needs to avoid the first water inlet 160, that is, the first water outlet hole 110 cannot affect the first water inlet 160, to avoid disturbance of a water flow. In other embodiments, the first water outlet hole 110 may be provided at a lower portion of a front end surface or a lower portion of a rear end surface opposite to the handle 400. This is not particularly limited herein, provided that the first water outlet hole 110 can be located at a lower position on the robot when the user holds the handle 400.

In an embodiment, the lower end surface of the housing 100 is connected to a rear end surface 101 of the housing 100 through a gap, and a first water outlet hole 110 is formed by the gap. In an embodiment, the first water outlet hole 110 formed by the gap and the first water outlet hole 110 provided on the lower end surface of the housing 100 may exist at the same time to further increase the drainage speed.

Figure 6:
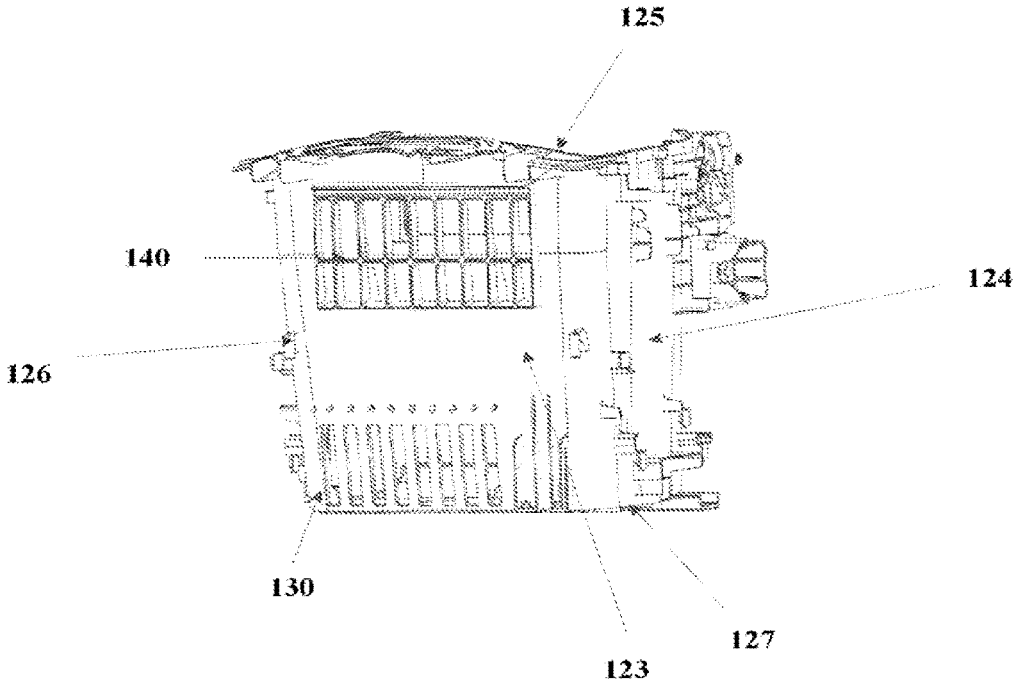
FIG. 6 is a diagram of a structure of an accommodation cavity according to an embodiment of this application.

In an embodiment, the second water outlet hole 130 may be provided on a side wall of the accommodation cavity 120, and the side wall is away from the handle 400 to facilitate opening and closing of the water baffle plate 300. As shown in FIG. 6, the side wall of the containment cavity 120 includes a first side wall 123, a second side wall 124, a third side wall 125, and a fourth side wall 126. When the handle 400 is disposed at the front end of the housing 100, the second water outlet hole 130 may be provided on any one or more of the first side wall 123, the second side wall 124, and the fourth side wall 126 of the accommodation cavity 120. When the handle 400 is disposed at the rear end of the housing 100, the second water outlet hole 130 may be provided on any one or more of the second side wall 124, the third side wall 125, and the fourth side wall 126 of the accommodation cavity 120.

In an embodiment, in a state in which the pool robot is lifted, the second water outlet hole 130 is configured to be provided on a side wall at which a lowest point of the accommodation cavity is located. As shown in FIG. 1 and FIG. 6, the second water outlet hole 130 is provided on the first side wall 123 of the accommodation cavity 120.

In an embodiment, the second water outlet hole 130 may alternatively be provided on a bottom wall 127 of the accommodation cavity 120.

In an embodiment, as shown in FIG. 1, FIG. 2, and FIG. 6, the second water outlet hole 130 is provided close to the lower end surface of the housing 100, so that the water in the filtering box 200 can be sufficiently drained, and the residual water can be reduced.

Figure 4:
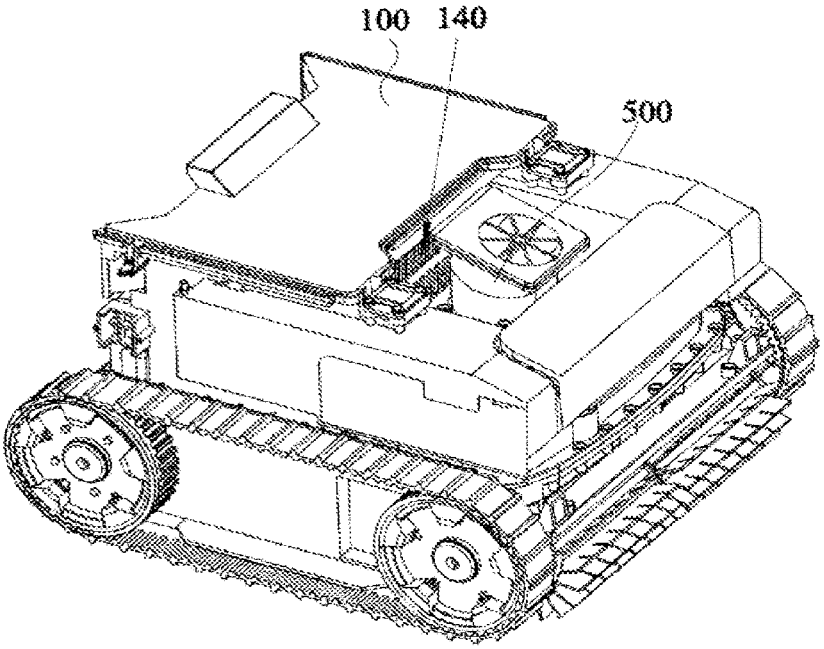
FIG. 4 is a diagram 2 of a structure of a pool robot according to an embodiment of this application.

In an embodiment, as shown in FIG. 4, a water inlet hole 140 is provided on the side wall of the accommodation cavity 120, and the water inlet hole 140 is provided close to an upper end surface of the housing 100. When the pool robot enters water, water outside the housing 100 can enter the filtering box 200 through the water inlet hole 140. This helps quickly increase the weight of the pool robot, so that the pool robot quickly enters the water, and therefore improves water entry efficiency of the pool robot.

Figure 7:
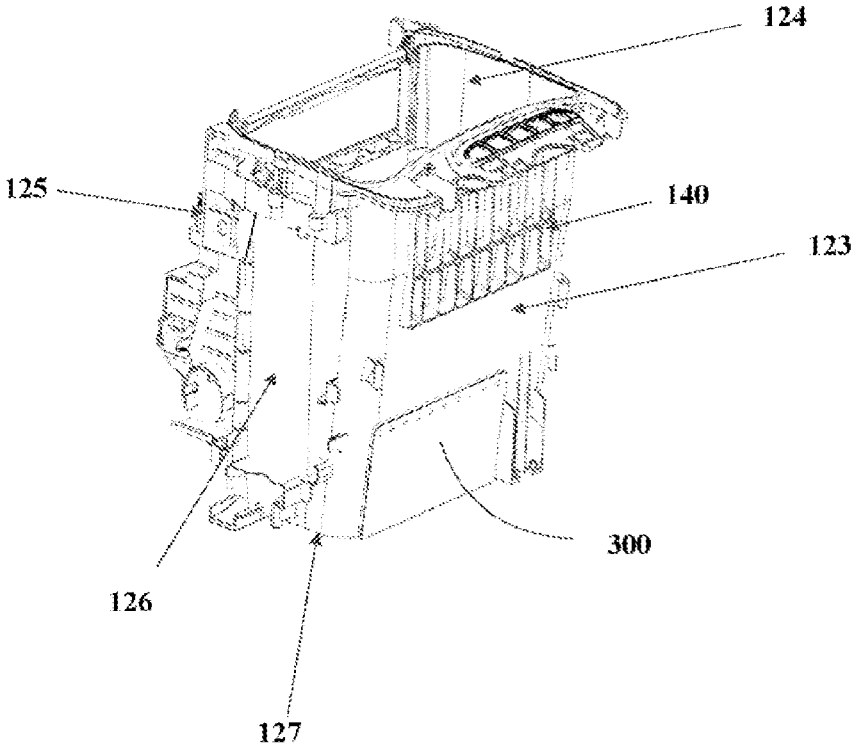
FIG. 7 is a diagram of a structure in which a second water outlet hole is closed by a water baffle plate according to an embodiment of this application.

As shown in FIG. 2, FIG. 6, and FIG. 7, the handle 400 is provided at the front end of the housing 100. The second water outlet hole 130 is provided on the first side wall 123 of the accommodation cavity 120. The second water outlet hole 130 is provided close to the lower end face of the housing 100. The water inlet hole 140 is provided close to the upper end face of the housing 100. The first water outlet hole 110 is provided at the rear end of the lower end face of the housing 100. In this way, when the pool robot enters the water, this helps quickly increase the weight of the pool robot, so that the pool robot quickly enters the water, and therefore improves water entry efficiency of the pool robot. When the pool robot leaves the water, this helps quickly drain water and therefore ensures drainage efficiency.

In an embodiment, as shown in FIG. 1, the filter driving mechanism 500 includes a main water pump. The main water pump includes an impeller 501 and a motor 502 that drives the impeller to rotate. The pool robot further includes an electric control box 600 having a sealed mounting cavity.

In an embodiment, as shown in FIG. 1, FIG. 2, and FIG. 6, the housing 100 is further provided with a first cavity 121. The first cavity 121 includes a first sub-cavity 121*a* and a second sub-cavity 121*b*. The first sub-cavity 121*a* and the second sub-cavity 121*b* are separated from each other. The accommodation cavity 120 communicates with the first sub-cavity 121*a* through the water inlet hole 140. A third water outlet hole 150 is provided on the housing 100 and communicates with the first sub-cavity 121*a*. The electric control box 600 is disposed in the second sub-cavity 121*b*. The motor 502 of the main water pump is disposed in the electric control box 600. An output shaft or a transmission shaft of the motor 502 extends out of a sealed upper cover 601 of the electric control box 600 and extends into the first sub-cavity 121*a* to be connected to the impeller to drive the impeller to rotate. In this way, the first water inlet 160, the filtering box 200, the water inlet hole 140, the first sub-cavity 121*a*, and the third water outlet hole 150 on the housing 100 sequentially communicate to form a first water path for the pool robot to perform cleaning. When the main water pump is turned on, liquid enters the filtering box 200 through the first water inlet 160 and the liquid inlet 202 of the filtering box 200, enters a gap between the accommodation cavity 120 and the filtering box 200 after being filtered in the filtering box 200, enters the first sub-cavity 121*a* through the water inlet hole 140, and finally is drained from the housing 100 through the third water outlet hole 150, to clean a side wall or a bottom wall of the pool.

As shown in FIG. 1, FIG. 2, and FIG. 7, the second water outlet hole 130 communicates with the second sub-cavity 121*b*. The second water outlet hole 130 is located between the first water inlet 160 and the first water outlet hole 110 along a moving direction of the pool robot. The second water outlet hole 130, the second sub-cavity 121*b*, and the first water outlet hole 110 sequentially communicate to form a second water path for quickly draining water. In a case where the pool robot is located in water, when the main water pump is turned on, the filtering box 200 and the accommodation cavity 120 are under negative pressure, so that water enters the pool robot through the first water outlet hole 110, and applies first pressure to the water baffle plate 300 on an outer side wall of the accommodation cavity 120 towards the inside of the accommodation cavity 120, and the first pressure is greater than second pressure applied by water in the accommodation cavity 120 to the water baffle plate 300 towards the outside of the accommodation cavity 120. Under the action of a pressure difference between the first pressure and the second pressure, the water baffle plate 300 can tightly cover, close, block, or seal the second water outlet hole 130, so that the water in the accommodation cavity 120 cannot be drained from the second water outlet hole 130 and cannot be drained from the pool robot through the first water outlet hole 110. When the pool robot is ready to leave the water, the main water pump is turned off, and the filtering box 200 and the accommodation cavity 120 are not under negative pressure. In or after the process in which the pool robot is leaving the water (that is, leaving the water surface), because the pool robot is lifted out of the water, water outside the accommodation cavity 120 is drained from the pool robot through the first water outlet hole 110, and the first pressure applied to the accommodation cavity 120 is canceled. In this case, the water in the accommodation cavity 120 and the water in the filtering box 200 drive, under the action of gravity of water (especially when the pool robot is obliquely lifted), the water baffle plate 300 to move away from the second water outlet hole 130, so that the second water outlet hole 130 is opened, and the water in the filtering box 200 and the water in the accommodation cavity 120 can be quickly drained from the pool robot through the second water outlet hole 130, the second sub-cavity 121*b*, and the first water outlet hole 110 sequentially. This increases the drainage speed of the pool robot in the process of leaving the water, quickly reduces the weight of the pool robot, and therefore improves user experience. Because the main water pump is in a turned-on state in a process in which the pool robot enters the water, the water baffle plate 300 keeps covering or closing the second water outlet hole 130 during this process. In other words, the water baffle plate 300 on the second water outlet hole 130 is in an open state only when the pool robot leaves the water surface, and the second water outlet hole 130 is opened for draining water. In other states, the water baffle plate 300 is always in a closed state, and the second water outlet hole 130 is closed and cannot be used for draining water. In other words, the first water path and the second water path are separated from each other.

Figure 8:
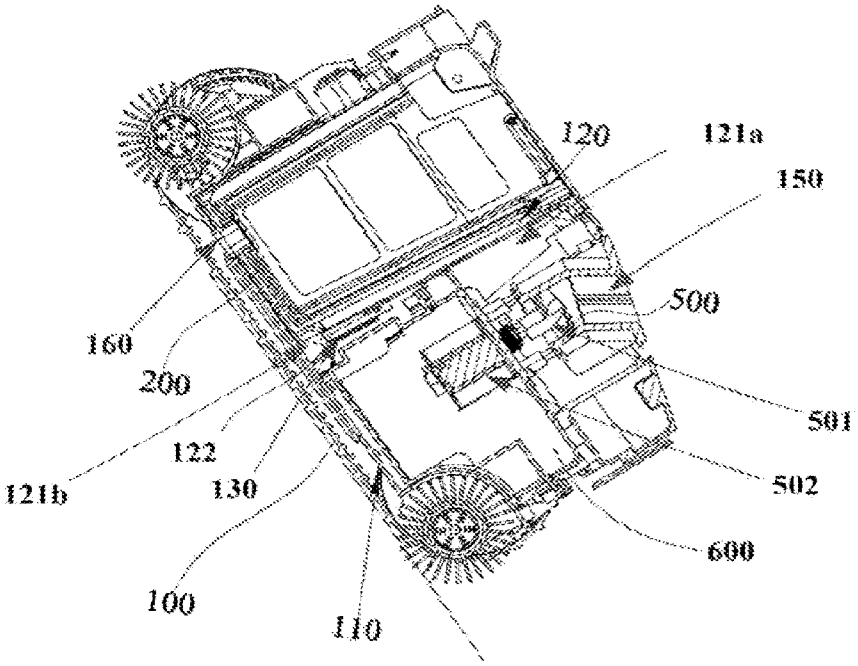
FIG. 8 is a diagram 1 of a cross-sectional structure of a pool robot according to another embodiment of this application.

In an embodiment, as shown in FIG. 8, the housing 100 is further provided with a second cavity 122. The second cavity 122 is provided in the second sub-cavity 121*b*. The second cavity 122 communicates with the accommodation cavity 120 through the second water outlet hole 130. A side wall of the second cavity 122 is provided with a fourth water outlet hole 170. The fourth water outlet hole 170 communicates with the second sub-cavity 121*b*. In this embodiment, the water baffle plate 300 is disposed on a side of the side wall of the second cavity 122, and the side of the side wall is away from the filtering box 200. A part of the water baffle plate 300 is connected to the side of the side wall of the second cavity 122, and the side of the side wall is away from the filtering box 200, that is, the water baffle plate is partially connected to the side of the side wall of the second cavity 122, and the side of the side wall is away from the filtering box 200. The water baffle plate 300 is provided over the fourth water outlet hole 170. When the pool robot is located in the water, the water baffle plate closes the fourth water outlet hole 170 to avoid the following case: Water enters the filtering box 200 through the fourth water outlet hole 170, affecting working efficiency of the pool robot. In or after the process in which the pool robot is leaving the water (that is, leaving the water surface), the water baffle plate 300 is opened, and the water in the filtering box 200 can flow out through the second water outlet hole 130, enter the second cavity 122, flow into the second sub-cavity 121*b* through the fourth water outlet hole 170, and finally be drained from the housing 100 through the first water outlet hole 110.

In an embodiment, as shown in FIG. 8, the fourth water outlet hole 170 is located between the first water inlet 160 and the first water outlet hole 110 along the moving direction of the pool robot. In the process in which the pool robot is leaving the water, the first water outlet hole 110 is located lower than the fourth water outlet hole 170, and the second water outlet hole 130, the second cavity 12, the fourth water outlet hole 170, the second sub-cavity 121*b*, and the first water outlet hole 110 sequentially communicate to form a second water path for quickly draining water. In a case where the pool robot is located in water, when the main water pump is turned on, the filtering box 200, the accommodation cavity 120, and the second cavity 122 are under negative pressure, so that water enters the pool robot through the first water outlet hole 110, and applies first pressure to the water baffle plate 300 on an outer side wall of the second cavity 122 towards the inside of the second cavity 122, and the first pressure is greater than second pressure applied by water in the second cavity 122 to the water baffle plate 300 towards the outside of the second cavity 122. Under the action of a pressure difference between the first pressure and the second pressure, the water baffle plate 300 can tightly cover, close, block, or seal the fourth water outlet hole 170, so that the water in the second cavity 122 cannot be drained from the fourth water outlet hole 170 and cannot be drained from the pool robot through the first water outlet hole 110. When the pool robot is ready to leave the water, the main water pump is turned off, and the filtering box 200, the accommodation cavity 120, and the second cavity 122 are not under negative pressure. In or after the process in which the pool robot is leaving the water (that is, leaving the water surface), because the pool robot is lifted out of the water, water outside the second cavity 122 is drained from the pool robot through the first water outlet hole 110, and the first pressure applied to the second cavity 122 is canceled. In this case, the water in the second cavity 122 and the water in the filtering box 200 drive, under the action of gravity of water (especially when the pool robot is obliquely lifted), the water baffle plate 300 to move away from the fourth water outlet hole 170, so that the fourth water outlet hole 170 is opened, and the water in the filtering box 200, the water in the accommodation cavity 120, and the water in the second cavity 122 can be quickly drained from the pool robot through the second water outlet hole 130, the second cavity 122, the fourth water outlet hole 170, the second sub-cavity 121*b*, and the first water outlet hole 110 sequentially.

In an embodiment, the second cavity 122 may alternatively be independent of the second sub-cavity 121. When the second cavity 122 is provided outside the second sub-cavity 121*b*, the fourth water outlet hole 170 is located between the first water inlet 160 and the first water outlet hole 110 along the moving direction of the pool robot. The second water outlet hole 130, the second cavity 122, the fourth water outlet hole 170, and the first water outlet hole 110 sequentially communicate to form a second water path for quickly draining water. During drainage, the water in the filtering box 200, the water in the accommodation cavity 120, and the water in the second cavity 122 are quickly drained from the pool robot through the second water outlet hole 130, the second cavity 122, the fourth water outlet hole 170, and the first water outlet hole 110 sequentially. For a specific structure of the fourth water outlet hole 170 and a mating manner of the fourth water outlet hole 170 and the water baffle plate 300, refer to a specific structure of the second water outlet hole 130 and a mating manner of the second water outlet hole 130 and the water baffle plate 300. Details are not described herein again.

Figure 9:
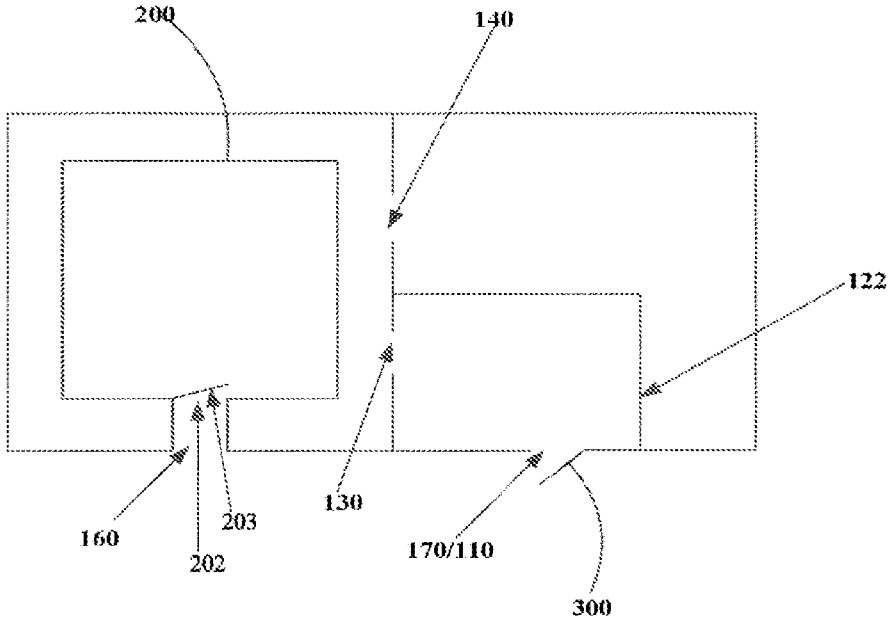
FIG. 9 is a brief diagram 1 of a pool robot according to another embodiment of this application.

In an embodiment, as shown in FIG. 9, the second cavity 122 is independent of the second sub-cavity 121, and the fourth water outlet hole 170 serves as the first water outlet hole 110 of the housing 100, that is, the water baffle plate 300 is disposed on the lower end surface or the rear end surface of the housing 100, or at a joint between the lower end surface and the rear end surface. For example, the water baffle plate 300 is disposed on the lower end surfaced. A part of the water baffle plate 300 is connected to the lower end face of the housing 100, that is, the water baffle plate 300 is partially connected to the lower end face of the housing 100, and the water baffle plate 300 is provided over the fourth water outlet hole 170 (namely, the first water outlet hole 110). When the pool robot is located in the water, the water baffle plate 300 closes the fourth water outlet hole 170 (namely, the first water outlet hole 110) to avoid the following case: Water enters the filtering box 200 through the fourth water outlet hole 170 (namely, the first water outlet hole 110), affecting working efficiency of the pool robot. In or after the process in which the pool robot is leaving the water (that is, leaving the water surface), the water baffle plate 300 is opened, and the water in the filtering box 200 can flow out through the second water outlet hole 130, enter the second cavity 122, and be drained from the housing 100 through the fourth water outlet hole 170 (namely, the first water outlet hole 110).

In an embodiment, the water baffle plate 300 is made of a flexible waterproof material. When the pool robot is in water, the water baffle plate 300 can be attached to an outer side of the side wall under the action of water pressure inside and outside the second water outlet hole 130, so that the water in the filtering box 200 does not flow out through the second water outlet hole 130, and outside water cannot enter through the second water outlet hole 130. When the pool robot leaves the water, because the water outside the filtering box 200 is quickly drained from the first water outlet hole 110, pressure outside the filtering box 200 decreases, and a part of the water baffle plate 300, wherein the part is not connected to the side wall, is driven under the action of gravity of water to be separated from the side wall to form a gap, so that the water is capable of being quickly drained from the gap. The water baffle plate 300 can selectively close the second water outlet hole 130 without any additional driving force. This can reduce costs and help simplify a structure of the pool robot.

In an embodiment, the water baffle plate 300 is movably provided on an outer side wall of the accommodation cavity 120 through an elastic member. When the pool robot is in water, the water baffle plate 300 covers, blocks, or seals the second water outlet hole 130 under the action of the elastic member. When the pool robot leaves the water, the water baffle plate 300 overcomes an action force of the elastic member and moves away from the second water outlet hole 130 under the action of gravity of the water in the accommodation cavity 120, so that the second water outlet hole 130 is opened. Alternatively, when the pool robot is in water, the elastic member stores energy under the action of the pressure difference between the first pressure and the second pressure, so that the water baffle plate 300 covers, blocks, or seals the second water outlet hole 130. When the pool robot leaves the water, the elastic member releases the stored energy after the first pressure is canceled, so that the water baffle plate 300 moves away from the second water outlet hole 130, and the second water outlet hole 130 is opened.

In an embodiment, the water baffle plate 300 includes a body and a rotating shaft. The body is provided over the second water outlet hole 130, the rotating shaft is disposed between the side wall and the body, and the rotating shaft is located at an upper side of the second water outlet hole 130.

The body is rotatably connected to the rotating shaft, so that when the pool robot leaves the water, the body can be driven to rotate under the action of gravity of the water to open the second water outlet hole 130. It should be noted that the "upper side" herein indicates a side of the pool robot and away from the ground when the pool robot is located on the ground.

In an embodiment, the water baffle plate 300 is driven by a driving assembly to move. The driving assembly includes a motor, a control system, and a sensor. The motor is in transmission connection to the rotating shaft. The motor is electrically connected to the control system. The control system is further electrically connected to the sensor. The sensor may be, but is not limited to, an attitude sensor, a water pressure sensor, or the like. The sensor is configured to detect a water-leaving state of the pool robot. When the sensor detects that the pool robot is in the water-leaving state, the sensor transmits a signal to the control system, and the control system starts the motor to drive the water baffle plate 300 to move away from the second water outlet hole 130, so that the second water outlet hole 130 is opened. When the sensor detects that the pool robot is in water, the sensor transmits a signal to the control system, and the control system starts the motor to drive the water baffle plate 300 to move close to the second water outlet hole 130, so that the second water outlet hole 130 is closed. In this embodiment, the second water outlet hole 130 may be provided on any side wall of the accommodation cavity 120, or may be provided on the bottom wall of the accommodation cavity 120.

In an embodiment, a surface area of the water baffle plate 300 facing the second water outlet hole 130 is greater than an area of the second water outlet hole 130, so that the water baffle plate 300 can fully be provided over the second water outlet hole 130. Optionally, a part of a perimetrical boundary of the water baffle plate 300 is connected to the side wall, that is, the perimetrical boundary of the water baffle plate 300 is intermittently connected to the side wall, so that after the pool robot leaves the water, the water in the filtering box 200 can overflow from the part of the water baffle plate 300, wherein the part is not connected to the side wall. Specifically, that the perimetrical boundary of the water baffle plate 300 is intermittently connected to the side wall may be that each side of the water baffle plate 300 is partially connected to the side wall, so that when the pool robot is located underwater, the water in the filtering box 200 is prevented from flowing out through the second water outlet hole 130 by using water pressure outside the side wall. However, after the pool robot leaves the water surface, the water pressure outside the water baffle plate 300 disappears. In this case, under the action of water pressure inside the filtering box 200, the part of the water baffle plate 300, wherein the part is not connected to the side wall, is driven to be separated from the side wall, so that the water in the filtering box 200 can flow out through the second water outlet hole 130. Certainly, that the perimetrical boundary of the water baffle plate 300 is intermittently connected to the side wall may alternatively be that at least one side of the water baffle plate 300 is connected to the side wall, the side includes at least an upper side of the water baffle plate 300, and the upper side is away from the ground, so that when the pool robot leaves the water, the side of the water baffle plate 300, wherein the side is not connected to the side wall, can be separated from the side wall to open the second water outlet hole 130. This helps quickly drain water and therefore ensures drainage efficiency.

In an embodiment, there are a plurality of first water outlet holes 110, and the plurality of first water outlet holes 110 are provided in an array. There are a plurality of second water outlet holes 130, and the plurality of second water outlet holes 130 are arranged in an array. This helps expand a drainage area and ensure drainage stability. Optionally, the first water outlet hole 110 and the second water outlet hole 130 are circular holes or grid holes.

In an embodiment, the pool robot further includes a filtering member. The filtering member may be disposed on an inner wall of the filtering box 200, wherein the inner wall corresponds to the second water outlet hole 130, or may be disposed at the first water outlet hole 110, to prevent garbage in the filtering box 200 from being carried out during drainage.

In an embodiment, an area of the first water outlet hole 110 ranges from 2000 $mm^2$ to 6000 $mm^2$, thereby ensuring a sufficient drainage area and improving drainage efficiency.

In addition, to fully drain the water inside the housing 100, an internal structure of the pool robot does not have an obvious right angle or dead angle. This prevents the internal water from remaining and not being fully drained for a long time. Optionally, when the handle 400 is lifted, the lower end surface of the housing 100 and a horizontal plane form an included angle of 45° to 75°, so that the water naturally flows out under the action of gravity. This helps increase the drainage proportion. In this embodiment, in a state in which the handle 400 is lifted, the lower end surface of the housing 100 and a horizontal plane form the included angle of 45°.

In an embodiment, the water inlet hole 140 is a grid hole, and an opening area of the grid hole is large. This helps improve the water entry efficiency.

It should be noted that the foregoing shows and describes basic principles and main features of this application and advantages of this application. A person skilled in the art should understand that this application is not limited to the foregoing embodiments, the foregoing embodiments and this specification only describe principles of this application, and various changes and modifications may be made to this application without departing from the spirit and scope of this application. These changes and modifications fall within the protection scope claimed in this application. The protection scope claimed in this application is defined by the appended claims and equivalents thereof.

What is claimed is:

1. A pool robot, comprising:

a housing, wherein a first water outlet hole is provided on a lower end surface of the housing, and the housing is provided with an accommodation cavity;

a filtering box disposed in the accommodation cavity, wherein a second water outlet hole is provided on the accommodation cavity;

a water baffle plate, wherein the water baffle plate is disposed on the accommodation cavity and provided over the second water outlet hole, and when the pool robot is located in water, the water baffle plate closes the second water outlet hole; and a handle, wherein the handle is provided on the housing, wherein in a process in which the pool robot is leaving the water, the handle is lifted, the first water outlet hole becomes located lower than the second water outlet hole, and the water baffle plate does not close the second water outlet hole, thereby allowing the second water outlet hole to communicate with the first water outlet hole, enabling water in the filtering box and water in the accommodation cavity to flow out through the second water outlet hole before being drained from the housing through the first water outlet hole.

2. The pool robot according to claim 1, wherein the water baffle plate is made of a flexible waterproof material.

3. The pool robot according to claim 1, wherein an area of the water baffle plate is greater than an area of the second water outlet hole.

4. The pool robot according to claim 1, wherein the second water outlet hole is provided on a side wall or a bottom of the accommodation cavity.

5. The pool robot according to claim 1, wherein at least one side of the water baffle plate is intermittently connected to the accommodation cavity.

6. The pool robot according to claim 1, wherein the handle is disposed at a front end of the housing.

7. The pool robot according to claim 1, wherein when the handle is lifted, the pool robot tilts.

8. The pool robot according to claim 7, wherein when the handle is lifted, the lower end surface of the housing and a horizontal plane form an included angle of 45° to 75°.

9. The pool robot according to claim 1, further comprising:

a filter driving assembly configured to drive the water in a pool to enter the filtering box, wherein the filtering box is closer to the handle than the filter driving assembly.

10. The pool robot according to claim 9, further comprising:

a first water inlet provided on the lower end surface of the housing;

a third water outlet hole provided on an upper end surface of the housing; and a first cavity provided in the housing, wherein:

the filter driving assembly comprises a main water pump, the main water pump is provided in the first cavity, and a water inlet hole is provided on a side wall of the accommodation cavity to allow the accommodation cavity to communicate with the first cavity; and the first water inlet, the filtering box, the accommodation cavity, the water inlet hole, the main water pump, and the third water outlet hole are sequentially in fluid communication to form a cleaning water path.

11. The pool robot according to claim 10, wherein the accommodation cavity is closer to the handle than the first cavity.

12. The pool robot according to claim 1, further comprising a filtering box cavity, wherein the filtering box cavity is disposed in the housing, and the accommodation cavity is formed in the filtering box cavity.

13. The pool robot according to claim 10, wherein the second water outlet hole is closer to the lower end surface of the housing than the water inlet hole.

14. The pool robot according to claim 10, wherein in a moving direction of the pool robot, a projection of the second water outlet hole on the lower end surface of the housing is located between the first water inlet and the first water outlet hole.

15. The pool robot according to claim 10, wherein in a forward direction of the pool robot, the handle, the filtering box, the water inlet hole, and the third water outlet hole are sequentially arranged from front to back.

16. The pool robot according to claim 10, further comprising:

an electric control box, wherein the electric control box comprises a sealed mounting cavity and a sealed upper cover, wherein:

the main water pump comprises an impeller and a motor, and the motor is disposed in the electric control box; and the first water inlet, the filtering box, the accommodation cavity, the water inlet hole, the impeller of the main water pump, and the third water outlet hole are sequentially in fluid communication to form the cleaning water path.

17. The pool robot according to claim 16, wherein the first cavity comprises a first sub-cavity and a second sub-cavity, wherein:

the electric control box is disposed in the second sub-cavity; and the impeller is disposed in the first sub-cavity, and an output shaft or a transmission shaft of the motor extends out of the sealed upper cover of the electric control box and extends into the first sub-cavity to be connected to the impeller to drive the impeller to rotate.

18. The pool robot according to claim 1, wherein there are a plurality of first water outlet holes, and the plurality of first water outlet holes are provided in an array, and/or there are a plurality of second water outlet holes, and the plurality of second water outlet holes are provided in an array.

19. The pool robot according to claim 1, wherein when the pool robot is located in the water, under the action of a main water pump, the water baffle plate is attached to the accommodation cavity, so that the water baffle plate closes the second water outlet hole; and in the process in which the pool robot is leaving the water, under a gravity of the water in the filtering box and a gravity of the water in the accommodation cavity, the water baffle plate is driven to move away from the second water outlet hole, so that the water baffle plate does not close the second water outlet hole.

20. A pool robot, comprising:

a housing, wherein a first water outlet hole is provided on a lower end surface of the housing, and the housing is provided with an accommodation cavity;

a filtering box disposed in the accommodation cavity, wherein a second water outlet hole is provided on the accommodation cavity; and a water baffle plate, wherein the water baffle plate is disposed on the accommodation cavity and provided over the second water outlet hole, and when the pool robot is located in water, the water baffle plate closes the second water outlet hole; and in a process in which the pool robot is leaving the water, the pool robot tilts, the first water outlet hole becomes located lower than the second water outlet hole, and the water baffle plate does not close the second water outlet hole, thereby allowing the second water outlet hole to communicate with the first water outlet hole, enabling water in the filtering box and water in the accommodation cavity to flow out through the second water outlet hole before being drained from the housing through the first water outlet hole.

* * * * *